US009194619B2

(12) United States Patent
Margotti et al.

(10) Patent No.: US 9,194,619 B2
(45) Date of Patent: Nov. 24, 2015

(54) REFRIGERATION SYSTEM

(71) Applicants: Birte Margotti, Tuebingen (DE); Stephan Roelke, Filderstadt (DE)

(72) Inventors: Birte Margotti, Tuebingen (DE); Stephan Roelke, Filderstadt (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 354 days.

(21) Appl. No.: 13/847,149

(22) Filed: Mar. 19, 2013

(65) Prior Publication Data

US 2013/0247603 A1 Sep. 26, 2013

(30) Foreign Application Priority Data

Mar. 21, 2012 (DE) ..... 10 2012 102 404

(51) Int. Cl.

| | |
|---|---|
| ***F25B 31/02*** | (2006.01) |
| ***F25B 31/00*** | (2006.01) |
| ***F25B 41/04*** | (2006.01) |
| *F25B 1/047* | (2006.01) |

(52) U.S. Cl.

CPC ..... *F25B 31/006* (2013.01); *F25B 31/008* (2013.01); *F25B 41/043* (2013.01); *F25B 1/047* (2013.01); *F25B 2400/0411* (2013.01); *F25B 2700/193* (2013.01); *F25B 2700/197* (2013.01); *F25B 2700/21175* (2013.01)

(58) Field of Classification Search

CPC ..... F25B 1/047; F25B 31/006; F25B 31/008; F25B 41/043; F25B 2400/0411; F25B 2700/193; F25B 2700/197; F25B 2700/21175

USPC ..... 62/196.1, 197, 199, 222, 259.2

See application file for complete search history.

(56) References Cited

U.S. PATENT DOCUMENTS

| | | | | |
|---|---|---|---|---|
| 3,913,346 | A | 10/1975 | Moody, Jr. et al. | |
| 6,357,242 | B1 | 3/2002 | Farley et al. | |
| 6,364,645 | B1 | 4/2002 | Dieterich | |
| 6,651,451 | B2 * | 11/2003 | Cho et al. | 62/197 |
| 2006/0243520 | A1 | 11/2006 | Hertenstein et al. | |
| 2012/0255318 | A1 * | 10/2012 | Kido et al. | 62/126 |

FOREIGN PATENT DOCUMENTS

| | | | |
|---|---|---|---|
| AU | 2003276015 | A1 | 5/2004 |
| CA | 1022425 | | 12/1977 |

(Continued)

*Primary Examiner* — Marc Norman
(74) *Attorney, Agent, or Firm* — Reinhart Boerner Van Deuren P.C.

(57) ABSTRACT

In order to improve a refrigeration system comprising a refrigeration circuit, in which a refrigerant compressor, a condenser following on from the refrigerant compressor, an expansion device following on from the condenser and an evaporator following on from the expansion device are arranged, the evaporator being connected to the refrigerant compressor, wherein the refrigerant compressor has a drive motor speed-controlled by an electronic motor control and a control cooling branch which has refrigerant flowing through it, branches off from the refrigeration circuit between the condenser and the expansion device and is guided to a connection of the refrigerant compressor and in which a cooling element is arranged which is connected in a heat conducting manner to electronic power components of the motor control, in such a manner that disruption to the operation of the motor control is avoided as far as possible it is suggested that a regulating device be provided for the control cooling branch and this regulate a temperature of the cooling element during operation of the refrigerant compressor such that a minimum evaporation temperature of the cooling element is above a freezing temperature and below a liquefying temperature of the refrigerant in the evaporator.

15 Claims, 7 Drawing Sheets

(56) References Cited

FOREIGN PATENT DOCUMENTS

| | | | |
|---|---|---|---|
| DE | 2548644 | A1 | 5/1976 |
| DE | 19845993 | A1 | 4/2000 |
| DE | 10345866 | A1 | 4/2004 |
| DE | 10359032 | A1 | 7/2005 |
| DE | 60122064 | T2 | 12/2006 |
| EP | 0 730 128 | A1 | 9/1996 |
| EP | 0 933 603 | A1 | 8/1999 |

* cited by examiner

REFRIGERATION SYSTEM

CROSS-REFERENCE TO RELATED PATENT APPLICATION

This patent application claims the benefit of German application No. 10 2012 102 404.9, filed Mar. 21, 2012, the teachings and disclosure of which are hereby incorporated in their entirety by reference thereto.

BACKGROUND OF THE INVENTION

The invention relates to a refrigeration system comprising a refrigeration circuit, in which a refrigerant compressor, a condenser following on from the refrigerant compressor, an expansion device following on from the condenser and an evaporator following on from the expansion device are arranged, the evaporator, for its part, being connected to the refrigerant compressor, wherein the refrigerant compressor has a drive motor speed-controlled by an electronic motor control, and a control cooling branch which has refrigerant flowing through it, branches off from the refrigeration circuit between the condenser and the expansion device and is guided to a connection of the refrigerant compressor and in which a cooling element is arranged which is connected in a heat conducting manner to electronic power components of the motor control.

Refrigeration systems of this type are known.

The problem with them is, however, that the cooling of the cooling element in the control cooling branch leads to problems in the electric motor control since either the electronic power components of the motor control become too hot or too great a cooling of the cooling element occurs which can lead to icing up or the formation of water condensation in the region of the cooling element which, again, causes disruption to the operation of the motor control.

The object underlying the invention is, therefore, to improve a refrigeration system of the generic type in such a manner that disruption to the operation of the motor control is avoided as far as possible.

SUMMARY OF THE INVENTION

This object is accomplished in accordance with the invention, in a refrigeration system of the type described at the outset, in that a regulating device is provided for the control cooling branch and this regulates a temperature of the cooling element during operation of the refrigerant compressor such that a minimum evaporation temperature of the cooling element is above a freezing temperature and below a liquefying temperature of the refrigerant in the condenser.

The advantage of this solution is, therefore, to be seen in the fact that by determining the minimum evaporation temperature which is above a freezing temperature of water, it can be ensured that the cooling element does not ice up.

It is even better when the minimum evaporation temperature of the cooling element is above a dew point temperature of the surroundings of the motor control.

With this solution it can be ensured that a condensation of water at the cooling element, which can likewise lead to disruption of the motor control, in particular to damage thereto, can also be prevented.

One particularly favorable solution provides for the temperature of the cooling element to be at least at a minimum evaporation temperature, which can be adjusted in the cooling element as a result of an evaporation pressure of the refrigerant, or higher.

As a result of the adjustment of the evaporation pressure it can be ensured that the temperature of the cooling element does not at any time fall below the minimum evaporation temperature corresponding to the evaporation pressure.

In order to ensure that a reliable temperature regulation of the cooling element also takes place during a start-up phase of the refrigerant compressor, it is preferably provided for a minimum flow of refrigerant to flow through the cooling element in a start-up phase of the refrigerant compressor.

The minimum flow of refrigerant through the cooling element ensures that a refrigeration capacity regulation for the cooling element is also functional in the start-up phase and begins as quickly as possible once the refrigerant compressor is switched on.

In this respect, it is particularly favorable when the regulating device allows a minimum flow of refrigerant through the control cooling branch in the start-up phase so that the entire control cooling branch has the minimum flow of refrigerant passing through it and, therefore, the temperature regulating device provided in it for the cooling element commences its regulatory activity.

With respect to the adjustment of the evaporation pressure in the cooling element, the most varied of solutions are conceivable.

One particularly favorable solution, for example, provides for the adjustment of the evaporation pressure in the cooling element to be brought about by an evaporation pressure regulator.

One particularly favorable solution provides for the regulating device to have an evaporation pressure regulator which regulates an evaporation pressure in the cooling element such that this is above a pressure at the connection of the refrigerant compressor, to which the control cooling branch is connected.

Such an evaporation pressure regulator can be a mechanical evaporation pressure regulator.

It is, however, also conceivable for the evaporation pressure regulator to be an electrically or electronically operating evaporation pressure regulator which, for example, activates a control valve in a pulse width modulated manner with a pressure control in order to regulate the evaporation pressure.

In this respect, it is particularly favorable when the evaporation pressure regulator permits the minimum flow of refrigerant in the start-up phase when the refrigerant compressor is switched on, i.e. the evaporation pressure regulator operates such that it allows the minimum flow of refrigerant in any case irrespective of the regulating device provided.

In this respect, it can be accepted that the evaporation pressure regulator is regulatorily inoperative or limitedly operative in the start-up phase when the refrigerant compressor is switched on.

An evaporation pressure regulation is of secondary importance in the start-up phase when the refrigerant compressor is switched on in contrast to the required minimum flow of refrigerant in order to ensure the capacity regulation of the cooling element.

Such a regulatory inoperativeness of the evaporation pressure regulator may be attained, for example, in the case of a mechanical evaporation pressure regulator or also an evaporation pressure regulator controlled electrically or electronically in that a bypass line with a flow control valve is associated with the evaporation pressure regulator, wherein the flow control valve defines the minimum flow of refrigerant and so the minimum flow of refrigerant through the control cooling branch is ensured irrespective of whether the evaporation pressure regulator is operating or not.

Another advantageous solution provides for the evaporation pressure regulator to comprise a control valve and a pressure control and for the pressure control to activate the control valve in the start-up phase of the refrigerant compressor such that it gives preference to the minimum flow of refrigerant ahead of the evaporation pressure regulation.

No more details have been given in conjunction with the preceding explanations concerning the individual embodiments as to how a temperature regulation of the cooling element can take place.

One particularly favorable solution provides for the connection of the refrigerant compressor for the control cooling branch to not be the connection of the refrigerant compressor which is connected to the evaporator but rather a connection of the refrigerant compressor which is at a pressure, for example an intermediate pressure of the refrigerant compressor, which is higher relative to the connection connected to the evaporator.

In the case where the refrigerant compressor is designed as a screw compressor it is provided, for example, for the connection of the refrigerant compressor which is connected to the control cooling branch to lead to a closed compressor chamber of the screw compressor.

Such a solution has the great advantage that, as a result, it is possible not to compromise the intake volume of the refrigerant compressor by the flow of refrigerant which is conveyed through the control cooling branch.

In addition, this solution has the advantage that, as a result, a level of pressure is already predetermined by the connection of the refrigerant compressor which ensures a level of pressure and, therefore, a temperature in the cooling element which is above the lowest possible temperature of the evaporator even when a regulating function of the evaporation pressure regulator is not available.

For example, an electronic temperature regulating device with a controlled regulating valve would be conceivable.

An electronic temperature regulating device with a controlled regulating valve does, however, have disadvantages with respect to the costs and reliability.

For this reason, one particularly advantageous solution provides for the control cooling branch to comprise a thermostatic expansion valve which is upstream of the cooling element and is controlled by a temperature sensor on the cooling element.

The temperature sensor could be provided in the center or in the course of a cooling channel in the cooling element.

The temperature sensor is, however, expediently arranged at an exit connection of the cooling element.

In order to also ensure, when a thermostatic expansion valve is provided, that a minimum flow of refrigerant flows through the cooling element in the start-up phase of the refrigerant compressor, it is preferably provided for a bypass line with a flow control valve to be associated with the expansion valve.

Such a bypass line for the expansion valve creates the possibility of having a minimum flow of refrigerant flowing through the cooling element in the start-up phase even with a closed expansion valve and, therefore, to also build up, for example, an evaporation pressure which leads to the evaporation pressure regulator starting to work and, therefore, likewise permitting the minimum flow of refrigerant in the start-up phase, irrespective of whether the expansion valve is already regulating or not.

This minimum flow of refrigerant through the cooling element ensures that the expansion valve can react quickly when the cooling element heats up in order to prevent any overheating of the cooling element and, therefore, also any overheating of the electronic power components.

Additional features and advantages of the invention are the subject matter of the following description as well as the drawings illustrating several embodiments.

DETAILED DESCRIPTION OF THE INVENTION

Figure 1:
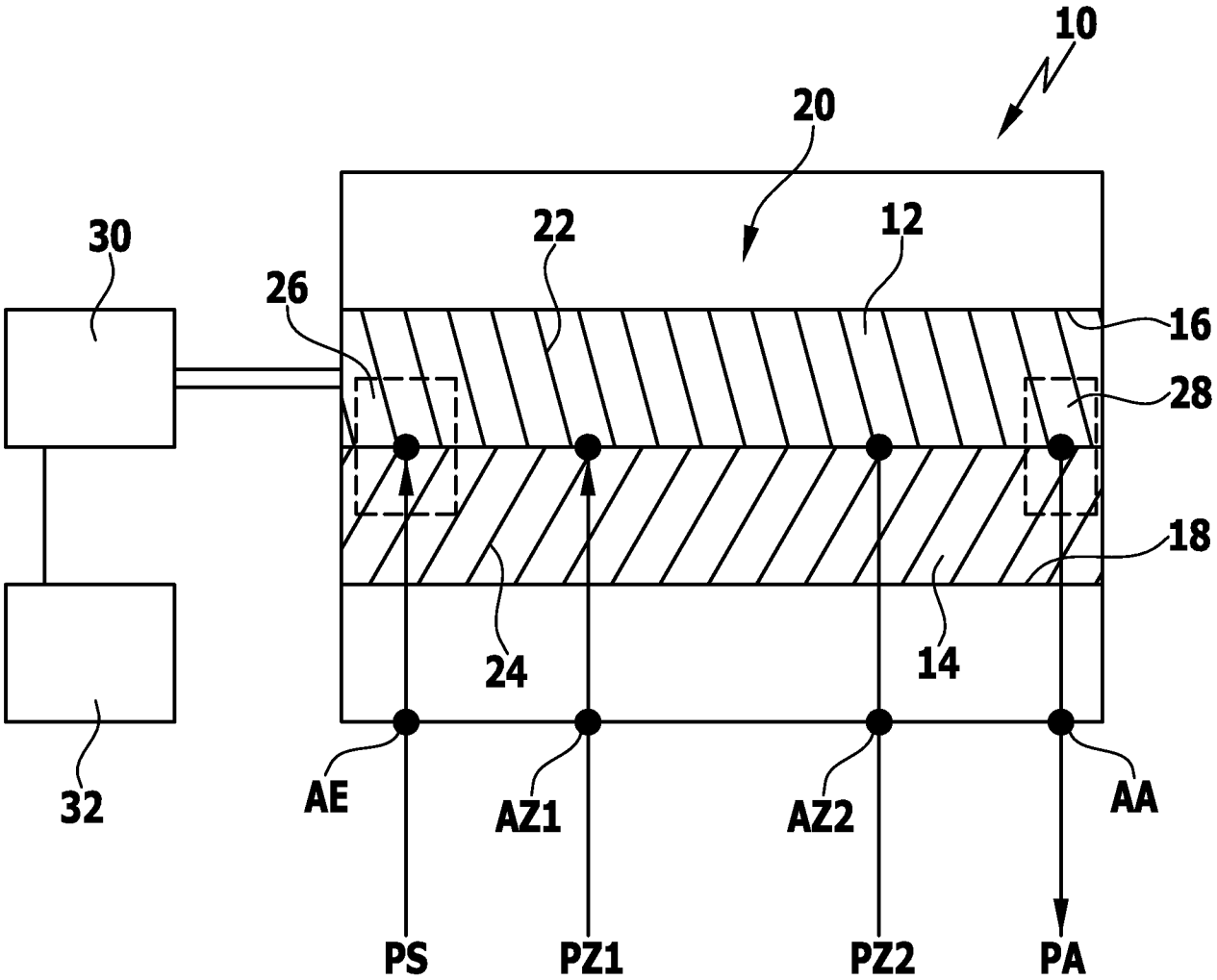
FIG. 1 shows a schematic illustration of a refrigerant compressor.

One embodiment of a refrigerant compressor 10 used in accordance with the invention is designed as a screw compressor, as described, for example, in the German patent applications DE 198 45 993 or DE 103 59 032 A1.

Such a screw compressor comprises, for example, a first screw rotor 12 and a second screw rotor 14 which are arranged in screw rotor bores 16 and 18, respectively, of a screw compressor housing 20 so as to be rotatable and engage in one another with their screw contours 22 and 24, respectively, on their circumferential sides, wherein the screw contours 22 and 24 form compressor chambers, which are at least partially opened, in the region of an inlet window 26 arranged on the suction side and, adjoining the inlet window 26, form compressor chambers which are closed and increasingly reduced in volume and which, on the other hand, open into an outlet window 28, which is arranged on the pressure side of the screw rotors 16 and 18, in the region thereof.

As a result, a suction pressure PS prevails at the inlet window 26 and an outlet pressure PA, which is above the suction pressure PS, at the outlet window 28.

In the case of a screw compressor, it is, however, also possible to supply refrigerant to the compressor chambers which are closed by the screw contours 22 and 24 following the inlet window 26 at an intermediate pressure PZ, for example at an intermediate pressure level PZ1 which is formed in the closed compressor chambers formed after the inlet window 26 or at an intermediate pressure level PZ2 which is present in the compressor chambers close to the outlet window 28.

In order to be able to supply refrigerant to the screw compressor at the various pressure levels, this is provided with an inlet connection AE, at which refrigerant is supplied at the suction pressure, with an intermediate pressure connection AZ1, at which refrigerant can be supplied at the intermediate pressure PZ1, with an intermediate pressure connection AZ2, at which refrigerant can be supplied at the intermediate pressure PZ2, as well as with an exit connection AA, at which refrigerant exits at the exit pressure PA.

Figure 2:
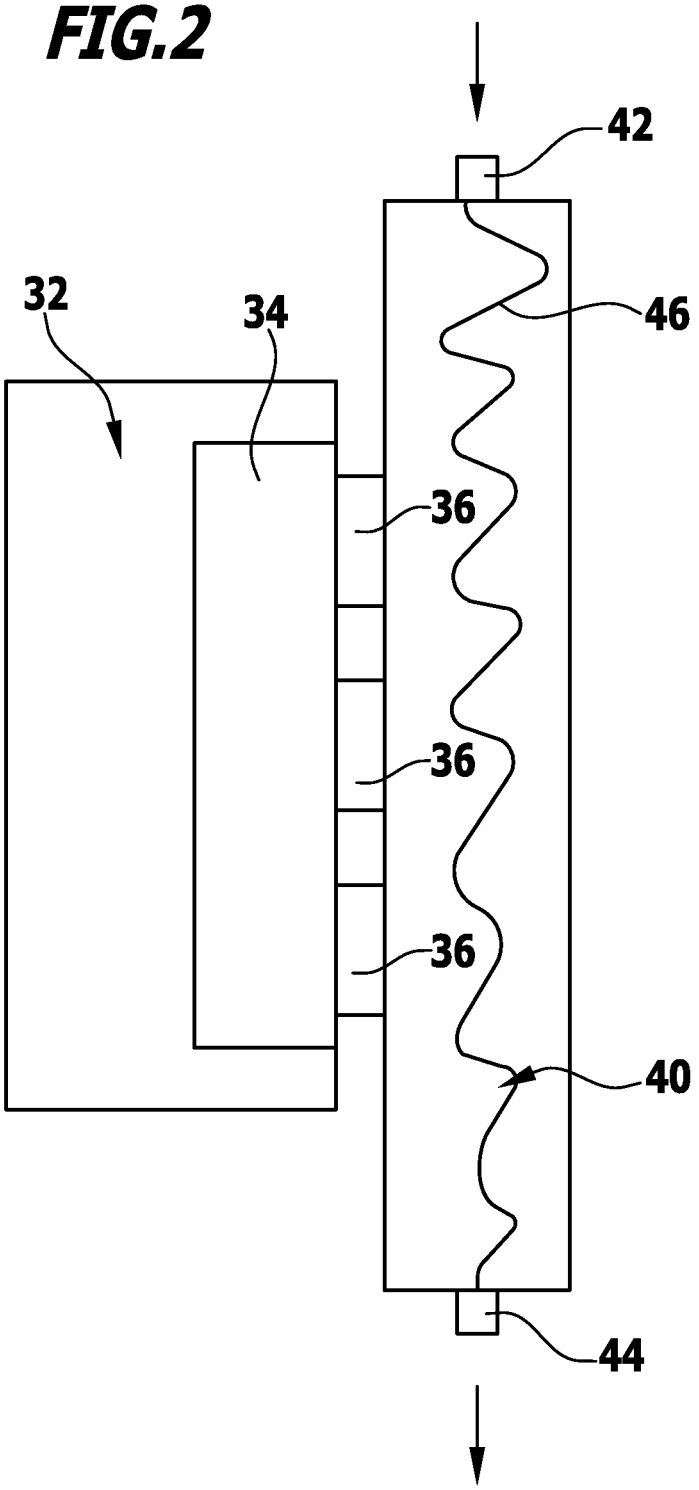
FIG. 2 shows a schematic illustration of a motor control of the refrigerant compressor with a cooling element coupled in it.

For the purpose of driving the screw rotors 12 and 14, one of the screw rotors can be driven by a drive motor 30 which can be activated by a motor control 32 in a speed controlled manner, wherein the motor control 32, as illustrated in FIG. 2, comprises an electronic speed control 34, for example an inverter which has electronic power components 36 which are subject to a considerable temperature load and develop considerable heat during operation of the drive motor 30 with the motor control 32 and display a shortened service life when heat builds up too much during operation of the drive motor 30.

For this reason, it is necessary to couple the electronic power components 36 thermally to a cooling element 40, to which they can pass their heat.

In order to avoid any overheating of these electronic power components 36, the cooling element 40 is provided with an entry connection 42 and an exit connection 44 for a refrigerant and a cooling channel 46 extends in the cooling element 40 between the entry connection 42 and the exit connection 44, this cooling channel 46 having refrigerant flowing through it and extending in the cooling element 40 in such a manner that the cooling element 40 can, essentially, be evenly cooled with the refrigerant; the cooling channel 46 extends, in particular, such that an optimum discharge of heat from the electronic power components 36 coupled thermally to the cooling element 40 is possible via the refrigerant flowing through the cooling channel 46.

Figure 3:
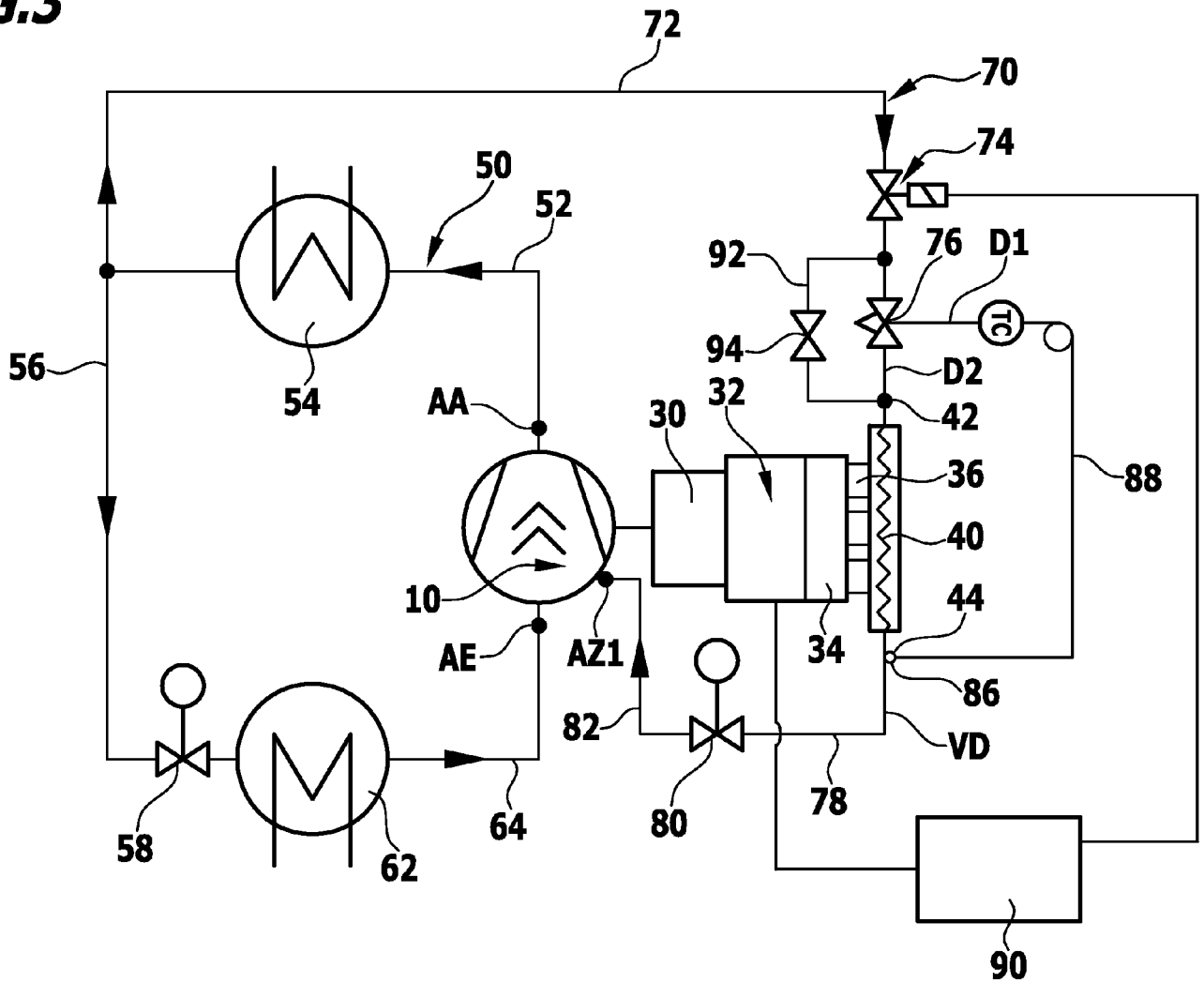
FIG. 3 shows a schematic illustration of a first embodiment of a refrigeration system according to the invention.

In a first embodiment of a refrigeration system according to the invention, illustrated in FIG. 3, the refrigerant compressor according to FIG. 1 is arranged in a refrigeration circuit designated as a whole as 50, wherein an exit connection AA of the refrigerant compressor 10 is connected via a first connection line 52 to a condenser 54, in which the refrigerant exiting from the exit connection AA of the refrigerant compressor 10 under pressure is liquefied.

Furthermore, the condenser 54 is connected via a connection line 56 to an expansion device 58 which is followed by an evaporator 62 which, for its part, is connected via a connection line 64 to the input connection AE of the refrigerant compressor 10.

The refrigeration circuit 50 is, therefore, a conventional refrigeration circuit, as is normally present in refrigeration systems.

A control cooling branch 70 branches off from the refrigeration circuit 50 for the purpose of cooling the cooling element 40, for example from the connecting line 56 between the condenser 54 and the expansion device 58, wherein a first connecting line 72 of the control cooling branch 70 leads to a switch-on valve 74 of the control cooling branch 70 which is followed by a thermostatic expansion valve 76 which is connected to the entry connection 42 of the cooling element 40 which is arranged in the control cooling branch 70.

An exit connection 44 of the cooling element 40 is followed by a connecting line 78 which leads to an evaporation pressure regulator 80 which, for its part, is connected via a connecting line 82 to an intermediate pressure connection, for example the intermediate pressure connection AZ1 of the refrigerant compressor 10.

The fact that the connecting line 82 is guided to the intermediate pressure connection AZ1 results in the evaporation pressure VD in the cooling element 40 already being higher than the suction pressure PS of the refrigerant compressor 10 without any regulating action of the evaporation pressure regulator 80. For example, the evaporation pressure VD in the cooling element 40 is at least at the pressure PZ1 of the refrigerant compressor 10 without the evaporation pressure regulator 80 being operative.

However, the evaporation pressure VD may be raised even further above the intermediate pressure PZ1 of the refrigerant compressor 10 as a result of the evaporation pressure regulator 80.

Such an increase in the evaporation pressure VD in the cooling element 40 has the purpose of ensuring that the evaporation temperature of the refrigerant flowing through the control cooling branch 70, which is adjusted in the cooling element 40, is above the freezing temperature of water in order to prevent any icing up of the cooling element 40. Preferably, the evaporation pressure VD is so high that the evaporation temperature is above a dew point temperature of the surroundings in order to prevent any condensation of water on the cooling element 40.

The reason for this is that either icing up of the cooling element 40 or the condensation of water on the cooling element 40 can lead in the short or long term to damage to the speed control 34 or the entire motor control 32, also, in particular, to short circuits in them.

As a result, the evaporation pressure regulator 80 offers the possibility, via the evaporation pressure VD in the cooling element 40, of determining a minimum evaporation temperature in the cooling element 40 which it does not fall below even at full cooling capacity of the control cooling branch 70.

The regulation of the cooling capacity in the cooling element 40 is brought about by the expansion valve 76 which has a temperature sensor 86 which detects the temperature at the exit connection 44 of the cooling element 40 and in the expansion valve 76 communicates the temperature at the exit connection 44 of the cooling element 40.

In this respect, the expansion valve 76 is preferably a thermostatic expansion valve which regulates in accordance with a differential pressure which results from the difference between a first pressure, generated by a medium which is heated up in the temperature sensor 86 and supplied to the expansion valve 76 via a capillary tube 88, and a second pressure D2 of the refrigerant which is present at the entry connection 42 of the cooling element 40 or at the exit connection 44 of the cooling element 40.

Such a thermostatic expansion valve 76 operating with a differential pressure is, on the one hand, inexpensive, on the other hand, maintenance-free and has a long service life.

Such a thermostatic or mechanical expansion valve 76 can, however, not be controlled by a control 90 of the control cooling branch 70 and so the following problems occur when the refrigerant compressor 10 is switched on.

When the refrigerant compressor 10 is switched off, the switch-on valve 74 will be closed by the control 90 and so the pressure in the cooling element corresponds at the most to the evaporation pressure VD set by the evaporation pressure regulator 80.

The evaporation pressure regulator 80 is likewise preferably a mechanical pressure regulator which regulates to a non-varying set reference pressure.

When the refrigerant compressor 10 is switched off, the pressure in the cooling element 40 can, however, also drop below the evaporation pressure VD predetermined by the evaporation pressure regulator 80.

If the refrigerant compressor 10 is switched on, the switch-on valve 74 will also be opened by the control 90 at the same time.

Since the pressure in the cooling element 40 corresponds to the evaporation pressure VD or is below this pressure, the evaporation pressure regulator 80 remains shut, i.e. no refrigerant can flow through the expansion valve 76 and the cooling element 40.

In addition, the expansion valve 76 also remains shut since the temperature measured by the temperature sensor 86 of the expansion valve 76 indicates no increase whatsoever.

Since the temperature of the electronic power components 36 rises relatively quickly when the refrigerant compressor 10 is starting up, the cooling element 40 will be heated up but this will become noticeable at the temperature sensor 86 only with a considerable delay since no refrigerant is flowing through the cooling element 40 and so the expansion valve 76 would still remain shut for such a time until the increase in temperature would have been detected at the temperature sensor 86.

This heating up leads to an undesired heating of the electronic power components 16 and so the drive motor 30 must be switched off many times for this reason in order to protect the electronic power components 36; such a heating up of the electronic power components 36 will, however, reduce their service life in any case.

For this reason, a bypass line 92 with a built-in flow control valve 94 is connected parallel to the expansion valve 76; the flow control valve 94 can be designed as a nozzle, capillary line or as a screen. In this respect, the bypass line 92 can be provided with the flow control valve 94 externally or internally.

When the refrigerant compressor 10 starts up and the switch-on valve 74 is opened by the control 90, the bypass line 92 with the built-in flow control valve 94 leads to the pressure of the refrigerant in the cooling element 40 rising above the evaporation pressure VD set by the evaporation pressure regulator 80, despite a closed expansion valve 76, due to the bypass line 92 connected parallel thereto and bridging it and so the evaporation pressure regulator 90 will open on account of this increase in pressure and, therefore, allow a flow of refrigerant through the cooling element 40 which results in the temperature sensor 86 also being able to detect any heating up of the refrigerant flowing through the cooling element 40 very quickly as a result of the heat of the electronic power components and resulting in an opening of the expansion valve 76 and so this takes over the required regulating function for the refrigerating capacity of the cooling element 40.

The first embodiment of the refrigeration system described in FIG. 3 already results, shortly after the refrigerant compressor 10 has started up, in an at least minimum flow of refrigerant through the cooling element 40 which causes the thermostatic expansion valve 76 to take up its regulating function and to lead to an adequate cooling of the cooling element 40 by the refrigerant flowing through the cooling element 40 and evaporating in it in good time prior to the cooling element 40 heating up to too great an extent.

Figure 4:
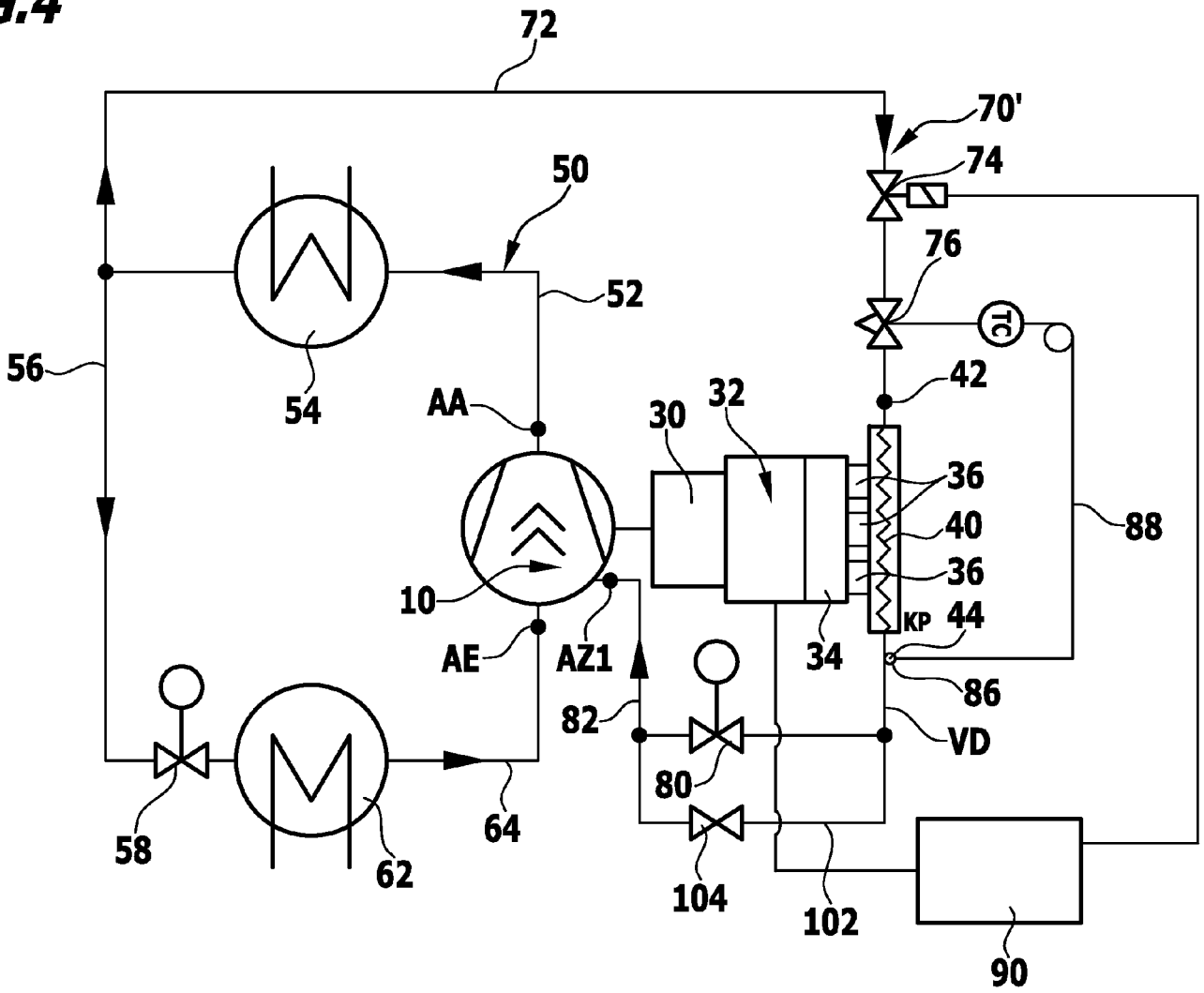
FIG. 4 shows a schematic illustration of a second embodiment of a refrigeration system according to the invention.

A second embodiment of a refrigeration system according to the invention, illustrated in FIG. 4, is given the same reference numerals insofar as it has the same elements as the first embodiment and so reference can be made in full to the comments on the first embodiment with respect to the description of these elements.

In contrast to the first embodiment, no bypass line 92 with a flow control valve 94 is provided parallel to the expansion valve 76 in this embodiment but rather a bypass line 102 with a flow control valve 104 parallel to the evaporation pressure regulator 80 which can be provided externally or internally. Furthermore, the flow control valve 94 can be designed as a nozzle, capillary line or screen.

When the refrigerant compressor 10 starts up, the switch-on valve 74 is likewise opened by the control 90 and the bypass line 102 and the flow control valve 104 will lead, even when the evaporation pressure regulator 80 would not open on account of too low a pressure in the cooling element 40, to a limited minimum flow of refrigerant through the cooling member 40 which results, on the other hand, in the temperature sensor 86 being able to react very quickly to any heating up of the refrigerant due to the contact with this refrigerant exiting at the exit connection 44 of the cooling element and, therefore, in the thermostatic expansion valve 76 commencing the regulation of the refrigerating capacity in the cooling element 40.

Following a certain start-up time, the pressure in the cooling element 40 increases at least to the evaporation pressure VD predetermined by the evaporation pressure regulator 80 and when this evaporation pressure VD is exceeded the evaporation pressure regulator 80 again begins to regulate.

As a result, it is likewise ensured that in the control cooling branch 70 the regulation for the cooling element 40 begins very quickly after the start-up of the refrigerant compressor 10.

As for the rest, the second embodiment functions in the same manner as the embodiment described above and so reference can be made in full thereto.

Figure 5:
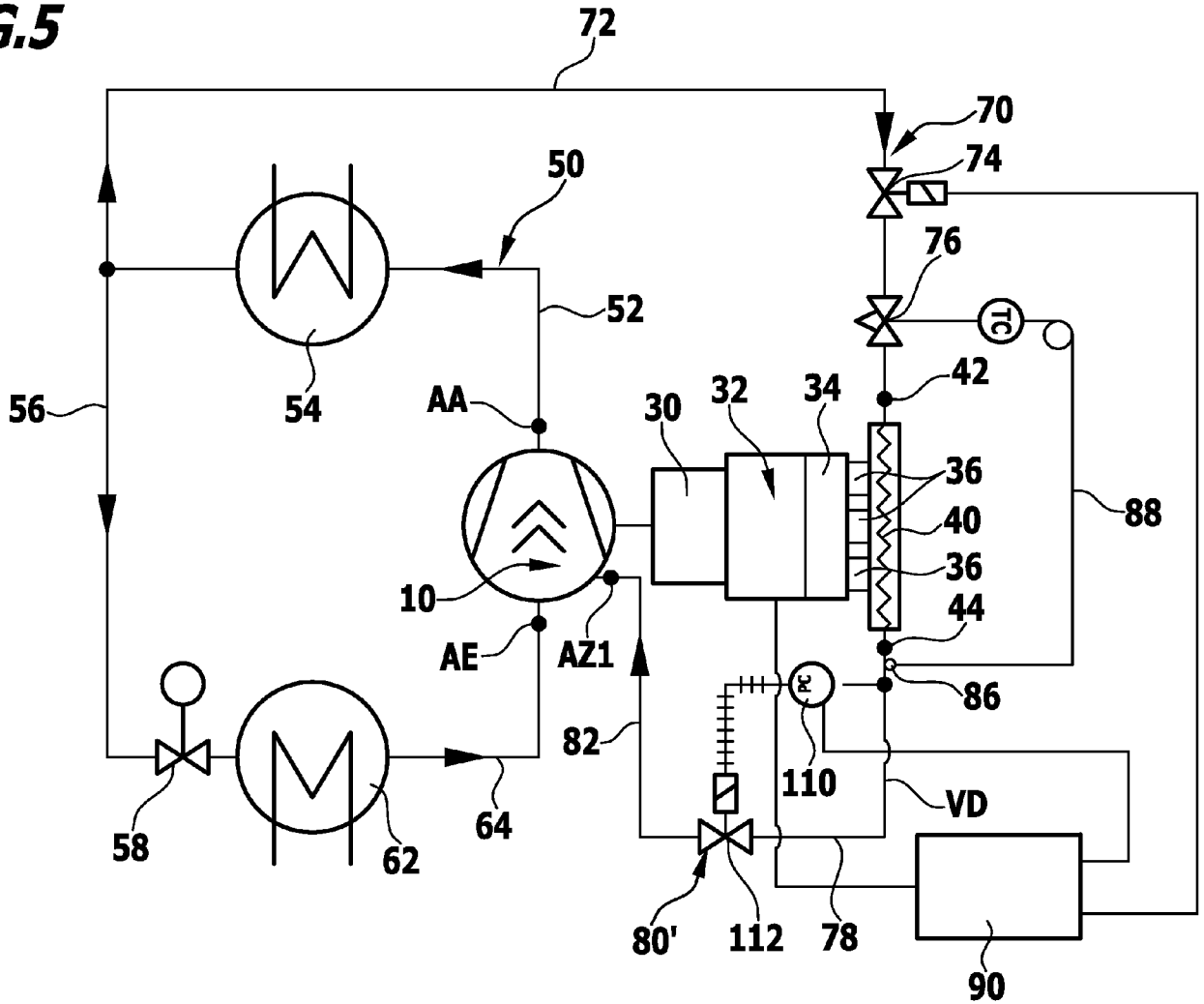
FIG. 5 shows a schematic illustration of a third embodiment of a refrigeration system according to the invention.

In a third embodiment of a refrigeration system according to the invention, illustrated in FIG. 5, those parts which are identical to those of the preceding embodiments are given the same reference numerals and so reference can be made in full to the comments on the preceding embodiments with respect to the description of these parts.

In contrast to the preceding embodiments, a bypass line with a flow control valve line is not associated either with the thermostatic expansion valve or the mechanical evaporation pressure regulator 80.

On the contrary, the mechanical evaporation pressure regulator 80 is replaced by an electrically controlled evaporation pressure regulator 80' which has a control valve 112 which is activated by a pressure control 110 with a control signal modulated as to pulse width and which is arranged between the connecting line 78 and the connecting line 82 in order to regulate the evaporation pressure VD in the cooling element 40 to the predetermined value.

This electrically controlled evaporation pressure regulator 80' can be controlled via the control 90 which interacts with the pressure control 110 such that the pressure control 110 controls the control valve 112 by way of a corresponding control signal modulated as to pulse width when the refrigerant compressor 10 starts up so that it allows a minimum flow of refrigerant through the control cooling branch 70 which ensures that the mechanical expansion valve 76 detects an increase in the temperature of the refrigerant flowing through the cooling element 40 very quickly with its temperature sensor 86 and, therefore, commences the regulation of the refrigerating capacity of the cooling element.

As for the rest, the third embodiment functions in the same way as the embodiments described above and so reference can be made to them in full.

Figure 6:
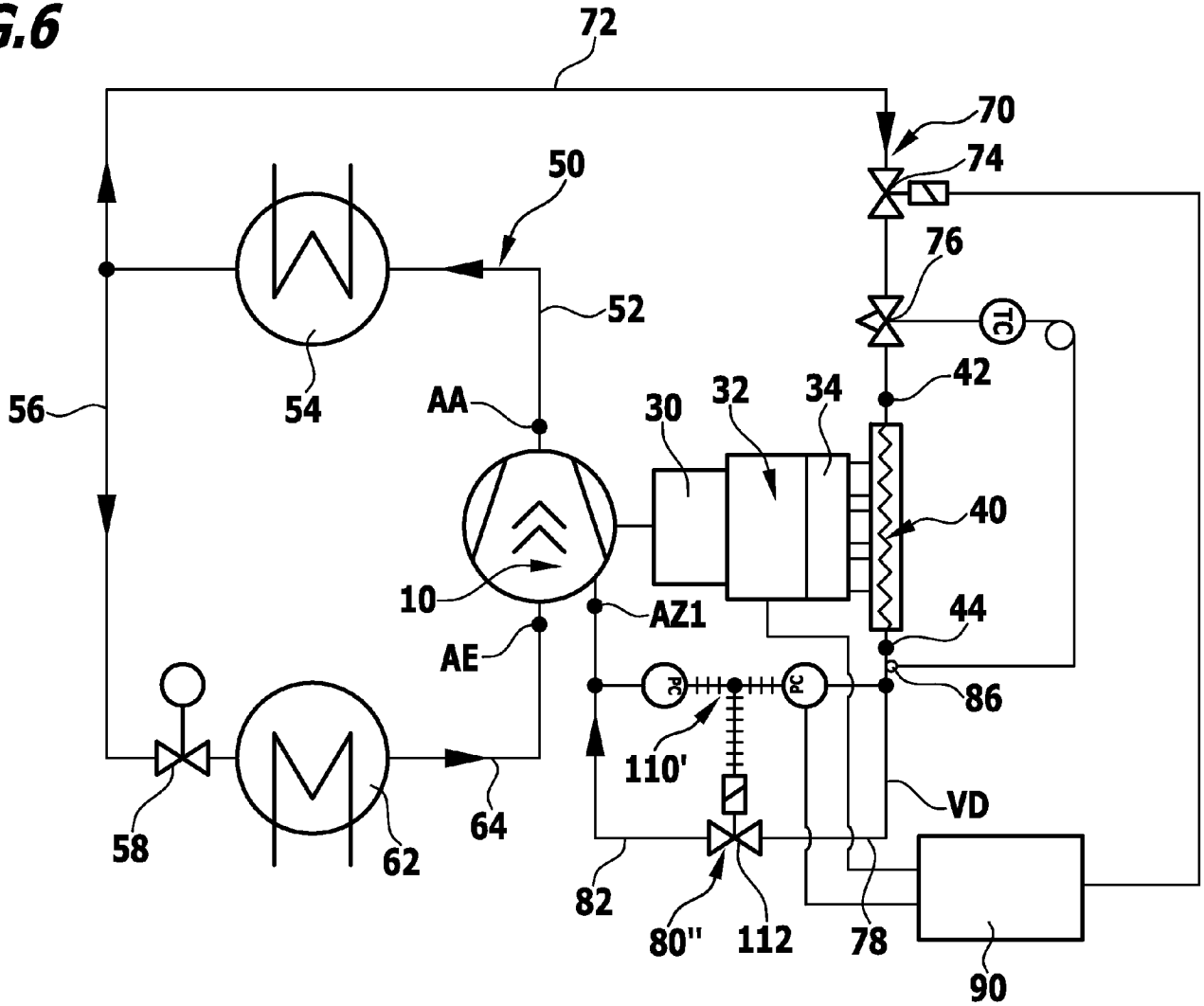
FIG. 6 shows a schematic illustration of a fourth embodiment of a refrigeration system according to the invention and FIG. 7 shows a schematic illustration of a fifth embodiment of a refrigeration system according to the invention.

In a fourth embodiment, illustrated in FIG. 6, those elements which are identical to those of the preceding embodiment are given the same reference numerals and so reference can be made in full to the comments on the preceding embodiments with respect to the description of these elements.

In contrast to the third embodiment, an electrically controlled evaporation pressure regulator 80" is likewise provided with the control valve 112 but the pressure control 110' is designed such that it detects, on the one hand, the evaporation pressure VD in the cooling element 40, for example in the connecting line 78, and, on the other hand, the pressure in the connecting line 82 and regulates the evaporation pressure VD to a minimum pressure in accordance with this difference in pressure.

This pressure control 110' can also be activated by the control 90 and so a minimum flow of refrigerant through the cooling element 40 can already be allowed when the refrigerant compressor starts up, irrespective of the pressure in the cooling element 40, due, in the first place, to a suitable control signal for the control valve 112 which is modulated as to pulse width and this ensures that the thermostatic expansion valve 76 with the temperature sensor 86 takes up the regulation for the cooling element 40 and does not set the evaporation pressure VD in the cooling element 40 to the predetermined evaporation pressure VD until after a certain start-up time of the evaporation pressure regulator 80".

As for the rest, the fourth embodiment functions in the same way as described in conjunction with the preceding embodiments and so reference can be made in full to the comments in conjunction with these embodiments.

Figure 7:
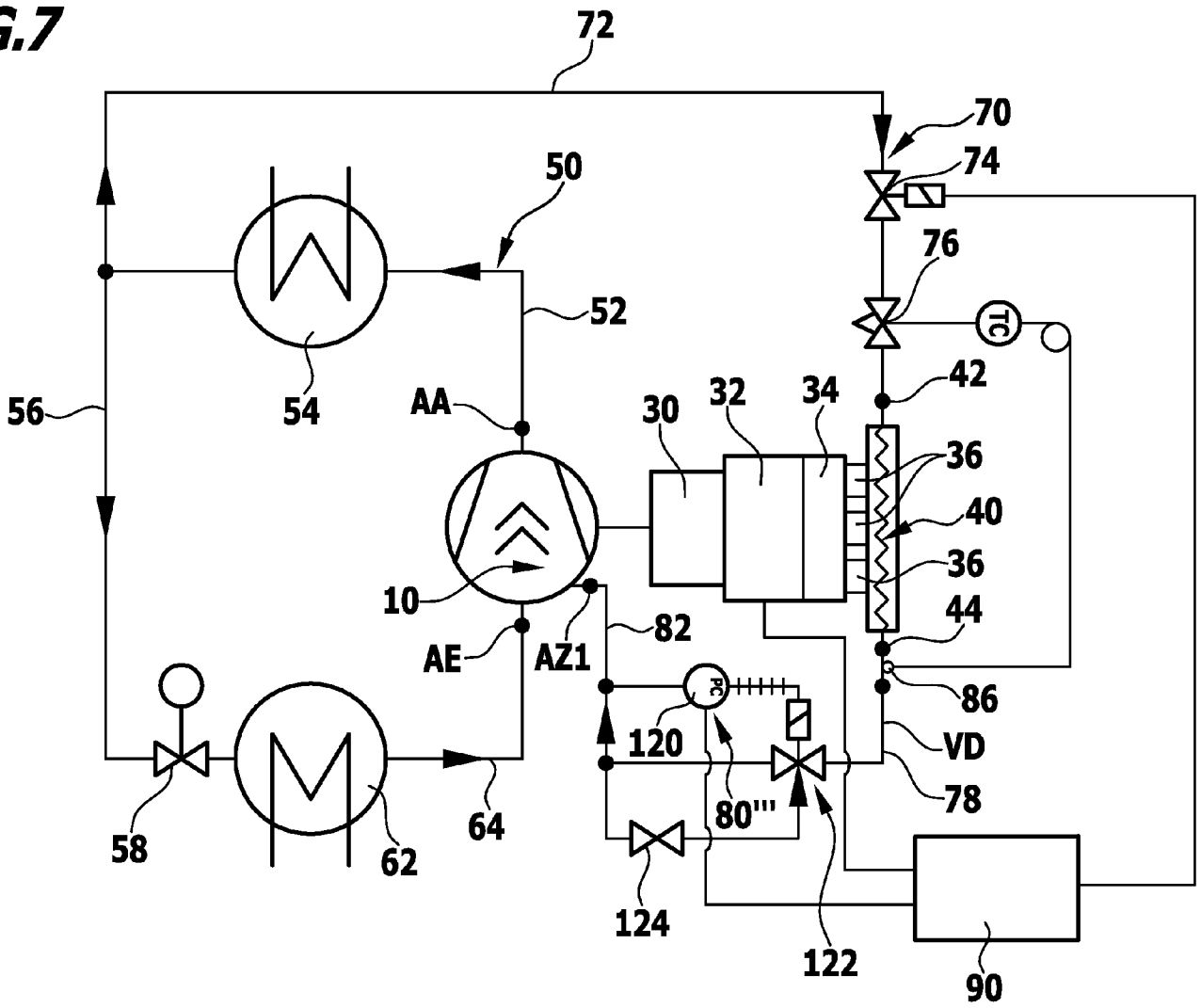

In a fifth embodiment, illustrated in FIG. 7, those parts which are identical to the preceding embodiments are likewise given the same reference numerals and so reference can be made in full to the comments on these embodiments with respect to the description of these parts.

In the fifth embodiment, an evaporation pressure regulator 80'" is provided instead of the electric evaporation pressure regulator 80" and this has a three-way control valve 122 which is controlled by a pressure control 120 and either connects the connecting line 78 directly to the connecting line 82 or connects it to the connecting line 82 via a flow control valve 124.

This evaporation pressure regulator 80'" controls the three-way control valve 122 with the pressure control 120 in accordance with the pressure in the connecting line 82 which leads to the connection AZ1 of the refrigerant compressor 10. The activation of the control valve 122 is brought about such that the pressure control 120 adjusts the control valve 122 such that it already connects the connecting line 78 to the connecting line 82 via the flow control valve 124 when the refrigerant compressor 10 is switched off.

If the refrigerant compressor 10 is now switched on, the pressure PZ1 prevails at the connection AZ1 and this is, however, lower than the desired evaporation pressure VD in the cooling element 40 and the pressure in the cooling element 40 will likewise be reduced to the pressure PZ1 first of all by the flow control valve 124.

This does, however, have the advantage that, as a result, a minimum flow of refrigerant through the cooling element 40 can likewise be ensured in a start-up phase of the refrigerant compressor 10 and so the mechanical expansion valve 76 with the temperature sensor 86 is fully functional immediately after the start-up of the refrigerant compressor 10.

Following the start-up phase, the three-way control valve 122 is switched over to a pulse-width modulated operation with regulation of the evaporation pressure in the cooling element 40 to the predetermined value VD.

The invention claimed is:

1. Refrigeration system comprising a refrigeration circuit, a refrigerant compressor, a condenser following on from the refrigerant compressor, an expansion device following on from the condenser and an evaporator following on from the expansion device being arranged in said circuit, said evaporator being connected to the refrigerant compressor, wherein the refrigerant compressor has a drive motor speed-controlled by an electronic motor control and a control cooling branch having refrigerant flowing through it, branching off from the refrigeration circuit between the condenser and the expansion device and being guided to a connection of the refrigerant compressor, a cooling element connected in a heat conducting manner to electronic power components of the motor control being arranged in said branch, wherein a regulating device is provided for the control cooling branch and regulates a temperature of the cooling element during operation of the refrigerant compressor such that a minimum evaporation temperature of the cooling element is above a freezing temperature and below a liquefying temperature of the refrigerant in the condenser.

2. Refrigeration system as defined in claim 1, wherein the minimum evaporation temperature of the cooling element is above a dew point temperature of surroundings of the motor control.

3. Refrigeration system as defined in claim 1, wherein the temperature of the cooling element is at least at a minimum evaporation temperature adjustable in the cooling element as a result of an evaporation pressure of the refrigerant or higher.

4. Refrigeration system as defined in claim 1, wherein a minimum flow of refrigerant flows through the cooling element in a start-up phase of the refrigerant compressor.

5. Refrigeration system as defined in claim 1, wherein the regulating device allows a minimum flow of refrigerant through the control cooling branch in the start-up phase of the refrigerant compressor.

6. Refrigeration system as defined in claim 1, wherein the adjustment of the evaporation pressure in the cooling element is brought about by an evaporation pressure regulator.

7. Refrigeration system as defined in claim 6, wherein the evaporation pressure regulator regulates the evaporation pressure in the cooling element such that it is above a pressure at the connection of the refrigerant compressor, the control cooling branch being connected thereto.

8. Refrigeration system as defined in claim 6, wherein the evaporation pressure regulator allows the minimum flow of refrigerant to pass through the control cooling branch in the start-up phase when the refrigerant compressor is switched on.

9. Refrigeration system as defined in claim 1, wherein the evaporation pressure regulator is regulatorily inoperative in the start-up phase when the refrigerant compressor is switched on.

10. Refrigeration system as defined in claim 6, wherein a bypass line with a flow control valve is associated with the evaporation pressure regulator.

11. Refrigeration system as defined in claim 6, wherein the evaporation pressure regulator comprises a control valve and a pressure control for the control valve and wherein the pressure control operates in the start-up phase of the refrigerant compressor such that it allows the minimum flow of refrigerant.

12. Refrigeration system as defined in claim 1, wherein the connection of the refrigerant compressor connecting it to the flow cooling branch is at a level of pressure above the level of pressure of the connection of the refrigerant compressor connected to the evaporator.

13. Refrigeration system as defined in claim 1, wherein the control cooling branch comprises a thermostatic expansion valve upstream of the cooling element, said expansion valve being controlled by a temperature sensor on the cooling element.

14. Refrigeration system as defined in claim 13, wherein the temperature sensor is arranged at an exit connection of the cooling element.

15. Refrigeration system as defined in claim 13, wherein a bypass line with a flow control valve is associated with the thermostatic expansion valve.

* * * * *